US007963049B2

(12) United States Patent
Messmer

(10) Patent No.: US 7,963,049 B2
(45) Date of Patent: Jun. 21, 2011

(54) SNOWBOARD BOOT

(75) Inventor: Karl Messmer, Schliersee (DE)

(73) Assignee: Head Germany GmbH, Feldkirchen (DE)

( * ) Notice: Subject to any disclaimer, the term of this patent is extended or adjusted under 35 U.S.C. 154(b) by 917 days.

(21) Appl. No.: 11/880,926

(22) Filed: Jul. 25, 2007

(65) Prior Publication Data

US 2008/0028641 A1 Feb. 7, 2008

(30) Foreign Application Priority Data

Jul. 28, 2006 (DE) ..... 10 2006 034 955

(51) Int. Cl.
*A43D 5/04* (2006.01)
*A43B 7/14* (2006.01)

(52) U.S. Cl. ..... 36/117.6; 36/50.5; 36/88; 36/117.7

(58) Field of Classification Search ..... 36/50.1, 36/117.1, 117.2, 122–125, 93, 88, 117.6, 36/50.5, 117.7
See application file for complete search history.

(56) References Cited

U.S. PATENT DOCUMENTS

| | | | | |
|---|---|---|---|---|
| 4,513,520 | A * | 4/1985 | Koch | 36/117.8 |
| 4,984,375 | A * | 1/1991 | Bonnet | 36/117.8 |
| 5,315,741 | A | 5/1994 | Dubberke | |
| 6,467,193 | B1 | 10/2002 | Okajima | |
| 6,792,702 | B2 * | 9/2004 | Borsoi et al. | 36/117.6 |
| 6,802,439 | B2 * | 10/2004 | Azam et al. | 223/113 |
| 6,952,891 | B2 | 10/2005 | Hirayama | |
| 7,159,340 | B2 | 1/2007 | Borsoi | |
| 7,281,341 | B2 * | 10/2007 | Reagan et al. | 36/50.1 |
| 7,428,789 | B2 * | 9/2008 | Holzer et al. | 36/88 |
| 2004/0074110 | A1 | 4/2004 | Borsoi | |
| 2006/0070261 | A1 | 4/2006 | Reagan et al. | |

FOREIGN PATENT DOCUMENTS

| | | | |
|---|---|---|---|
| EP | 1 444 909 | A1 | 11/2004 |
| FR | 2 770 379 | | 5/1999 |
| JP | 09201207 | A | 8/1997 |
| JP | 2003289901 | A | 10/2003 |
| JP | 2004236971 | A | 8/2004 |

* cited by examiner

*Primary Examiner* — Mickey Yu
*Assistant Examiner* — Chun Cheung
(74) *Attorney, Agent, or Firm* — Miller, Canfield, Paddock and Stone; Mark L. Maki

(57) ABSTRACT

In a snowboard boot having a soft inner shoe and a soft outer shoe, a tension member connected to the sole of the outer shoe is provided which is guided on the inner side of the outer shoe from one side over the inner shoe to a turning point connected to the sole on the other side on the inner side of the outer shoe. For operation, the tension means extends out of the outer shoe, whereby it is fixable in the tightened state.

16 Claims, 1 Drawing Sheet

SNOWBOARD BOOT

FIELD OF THE INVENTION

This invention relates to a snowboard boot having a soft inner shoe and a soft outer shoe, that is, to a so-called soft boot.

BACKGROUND OF THE INVENTION

The closure used in the soft boot is usually a lacing, i.e. a shoelace as a tension means which is guided through eyelets or similar turning points which are provided in closing flaps on the leg of the outer shoe on each side of the tongue so as to form crossing points on the tongue overlapped by the closing flaps.

Due to its support on the tongue and the turning points on the closing flaps which are pressed against the tongue increasingly when the shoelace is tightened, the friction of the lacing increases from the upper to the lower end of the tongue when the shoelace is tightened. This has the consequence that the leg area and thus the calf area can be firmly laced up, but not the lower zone.

However, firm lacing is important in snowboarding particularly in the lower zone, i.e. the foot area. The foot must e.g. not slip forward in the shoe during a backside turn, and there should be firm contact of the heel with the sole in a frontside turn when the heel is applied.

It is therefore the problem of the invention to provide a soft boot which has an easily operated firm fixing means also in the foot area.

This is obtained according to the invention by the snowboard boot having turning points in the instep and heel areas for a tension means.

SUMMARY OF THE INVENTION

In the inventive snowboard boot, the sole of the outer shoe has fastened thereto a tension means which is guided from one side over the inner shoe via at least one turning point fastened to the sole on the other side on the inner side of the shoe, extends out of the outer shoe for operation, and is fixable in the tightened state.

This forms between the outer shoe and the inner shoe an additional separate lacing for the lower zone, that is, the foot area, which firmly presses the foot against the sole of the outer shoe and thus fixes it. This substantially facilitates snowboarding.

Since the tension means extends to the outside, it is easily accessible and thus easy to operate, i.e. it can be tightened, fixed and undone without any need to get out of the shoe or the binding.

In the simplest case, the tension means can be guided from one side on the inner side of the outer shoe e.g. diagonally over the instep to a turning point on the other side in the heel area of the outer shoe.

However, it is preferable to provide at least two turning points, the first turning point being disposed in the instep area and the second turning point fastened in the area of the heel on the opposite side.

The tension means is preferably fastened to the sole on the inner side of the outer shoe before the instep. It can also be fastened to another place on the sole of the outer shoe, however, for example in the middle area of the sole when the tension means extends to a place located before the instep.

The tension means preferably extends to the outside from the turning point in the heel area. For this purpose, the tension means can be guided from the turning point in the heel area on the inner side of the leg of the outer shoe and exit only on the upper edge of the leg. However, there is preferably an opening e.g. in form of an eyelet provided in the leg e.g. halfway up, out of which the tension means extends to the outside.

For fixing the tension means any device can be provided, for example a Velcro closure, with one Velcro closure member on the tension means and one Velcro closure member on the leg of the outer shoe. However, it is preferable to provide, for fixing the tension means, a clamp which is advantageously fastened to the outer side of the leg of the outer shell, namely above the opening out of which the tension means exits from the inner side of the outer shoe to the outside.

The tension means is preferably formed by a shoelace, in particular made of synthetic fibers plaited into a thin string with a thickness of for example 2 mm to 4 mm. It may be a string and/or a band or the like.

The at least one turning point is preferably formed by an element made of a flat, flexible material which is fastened to the sole on the inner side of the outer shoe in at least two places spaced apart in the longitudinal direction of the shoe. For this purpose, the turning point can be e.g. a triangular fabric member which is provided at its tip e.g. with an eyelet through which the tension means is guided, the side of the triangle opposite the tip being connected to the outer sole.

However, the element consisting of the flat, flexible material is preferably formed by a band shaped into a loop whose two ends are connected to the outer sole at two places spaced apart in the longitudinal direction of the shoe. The tension means can be guided in the loop for turning, or an eyelet or the like can be provided for turning the tension means in the middle area between the two ends of the band.

The closure of the outer shoe can be formed in any desired way. It is thus possible to use buckles, for example. However, it is preferable to use the lacing of the outer shoe with a shoelace that is usual for soft boots, as described above. As likewise mentioned above, the lacing of the outer shoe reliably fixes the calf area in the leg area of the shoe. Moreover, a reliable separate fixing of the lower zone, that is, the foot, is permitted according to the invention. This permits separate individual adjustment of the fixing of the calf area in the snowboard boot, on the one hand, and the fixing of the foot area, on the other hand.

The lacing of the outer shoe can be effected here by a rotary closure in which the shoelace or other tension means acts with both end portions on a take-up spool formed as a rotary handle and rotatably mounted on a holder provided on the tongue of the outer shoe. A directional locking mechanism is provided between the rotary handle and the holder. For lacing, the rotary handle is pushed onto the bearing on the holder. In this position the directional locking mechanism is coupled, while in the position of the rotary handle pulled away from the holder it is uncoupled. Such a rotary closure is described for example in U.S. Pat. No. 5,315,741 A.

DETAILED DESCRIPTION

Figure 2:
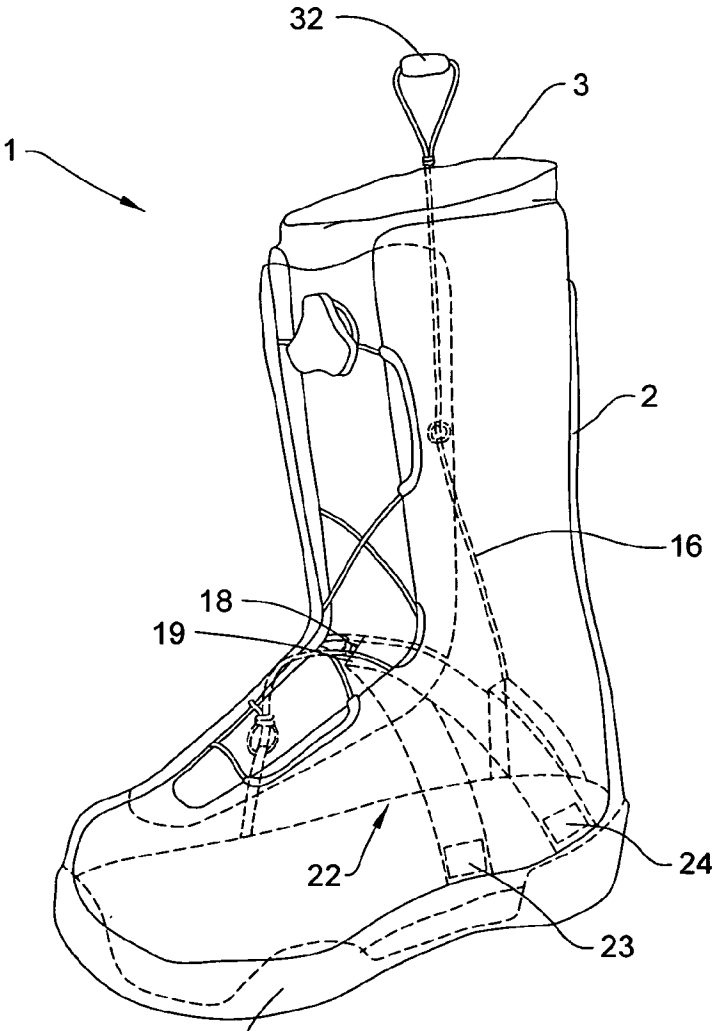
FIG. 2 is a perspective left side view thereof.
Figure 1:
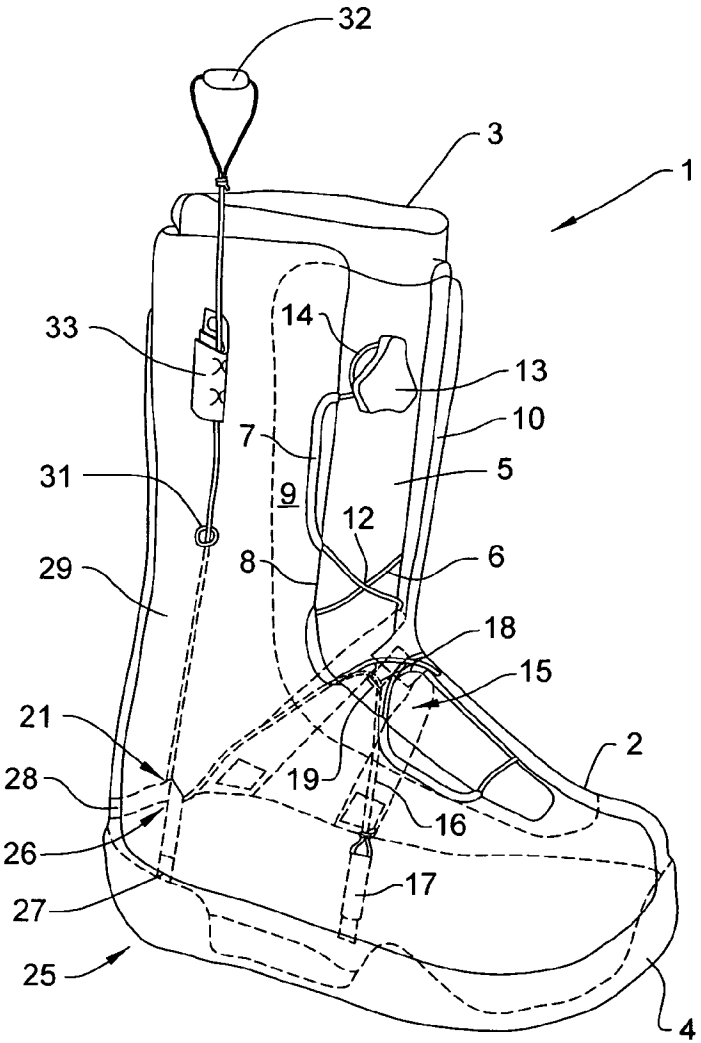
FIG. 1 is a perspective right side view of a snowboard boot.

An embodiment of the invention will hereinafter be described more closely by way of example with reference to the drawing, in which FIGS. 1 and 2 schematically show perspective views of the right soft boot from the outer side and the inner side, respectively.

The soft boot 1 consists of a soft, flexible outer shoe 2 and a soft, flexible inner shoe 3 of which only the upper end of the leg can be seen in the drawing.

The outer shoe 2 has a shell-like, relatively stiff sole 4 made of rubber-elastic material and a tongue 5. For lacing the outer shoe 2, a shoelace 6 is provided which is guided through turning points 7, 8 which are fastened to the closing flaps 9, 10 which are provided on the outer shoe 2 on each side of the tongue 5 so as to form crossing points 12 on the tongue 5 when the outer shoe 2 is laced up.

For lacing, a rotary closure is provided. For this purpose, both end portions of the shoelace 6 act on a take-up spool formed as a rotary handle 13 which is rotatably mounted on a holder 14 provided on the tongue 5. A directional locking mechanism (not shown) is provided between the take-up spool 13 and the holder 14. For lacing, the rotary handle 13 is pushed onto the bearing on the holder 14, thereby coupling the directional locking mechanism.

On the inner side of the outer shoe 2, i.e. between outer shoe 2 and inner shoe 3, a tension means formed as a shoelace 16 is provided which is fastened with a band 17 to the sole 4 on the right side of the right boot 1 shown in the drawing.

The shoelace 16 extends over the inner shoe 3 from its fastening point on the band 17 to a first turning point 18 on which it is guided through an eyelet 19 to a second turning point 21. The first turning point 18 with the eyelet 19 is disposed below the tongue 5 of the outer shoe 1 on the tongue (not shown) of the inner shoe 2 in the instep area 15.

The first turning point 18 is formed by a band loop 22 whose two ends 23, 24 are fastened at a space apart on the inner side of the outer shoe 2 to the sole 4 on the left or inner side of the right boot 1 shown in the drawing. The turning point 18 or eyelet 19 is located in the middle area between the ends 23, 24.

The second turning point 21 is located in the heel area 25 on the right side of the right boot 1 shown in the drawing, i.e. on the same side as the band 17 with which the shoelace 16 is fastened to the sole 4.

The second turning point is likewise formed by a band loop 26 whose two ends 27, 28 are fastened at a space apart to the sole 4. The shoelace 6 is drawn through the band loop 26 for guidance.

From the second turning point 21 the shoelace 16 first extends on the inner side in the leg 29 of the outer shoe 2, then exiting from the outer shoe 2 through an eyelet or similar opening 31 above the instep area 15.

A grip 32 is fastened to the end of the shoelace 6 to be used for tightening the shoelace 16 in order to reliably fix the foot in the soft boot 1 by the lacing comprising the shoelace 16 and by the turning points 18, 21 on the inner shoe 3.

To fix the shoelace 16 in the tightened position, a clamp 33 is provided on the outside of the leg 29 of the outer shoe 2 above the opening 31.

The invention claimed is:

1. A snowboard boot having a heel area, an instep area, a tongue, a soft inner shoe and a soft outer shoe with an outer sole and a closure overlapping the tongue, characterized in that a tension means is provided which is connected to the outer sole on a first side and is guided on the inner side of the outer shoe from the first side over the inner shoe to a first turning point, said first turning point being connected to a second side of the outer sole on the inner side of the outer shoe proximate the instep area, said tension means extending from the first turning point to a second turning point disposed in the heel area, wherein the tension means extends out of the outer shoe to the outside through an opening in a leg portion of the outer shoe, and a clamp is provided on the snowboard boot for fixing the tension means in a tightened state, said tension means extending out of the outer shoe for operation, and being fixable by the clamp in the tightened state.

2. The snowboard boot according to claim 1, characterized in that the tension means extends from a place located forwardly before the instep area on the first side and extends rearwardly in the longitudinal direction of the shoe over the instep area through the first turning point to the second turning point in the heel area.

3. The snowboard boot according to claim 1, characterized in that the second turning point is fastened to the outer sole on the same first side of the outer shoe as the tension means, and the first turning point is fastened to the outer sole on the opposite second side of the outer shoe.

4. The snowboard boot according to claim 1, characterized in that the tension means extends to the outside from the second turning point in the heel area through the opening so that the tension means is manually grippable for pulling the tension means into the tightened state.

5. The snowboard boot according to claim 1, characterized in that the clamp is disposed on the outer side of the leg portion of the outer shoe above the opening to permit pulling of the tension means into the tightened state and maintaining the tension means in the tightened state.

6. The snowboard according to claim 1, characterized in that the first and second turning points are formed by elements each made of a flat, flexible material which said elements are fastened to the sole on the inner side of the outer shoe in at least two places spaced apart in the longitudinal direction of the shoe.

7. The snowboard boot according to claim 6, characterized in that each said element is formed from a band loop which has two ends which are fastened to the outer sole at spaced apart locations in the longitudinal direction of the shoe.

8. The snowboard boot according to claim 1, characterized in that the closure of the outer shoe is formed by a lacing.

9. A snowboard boot having a heel area, an instep area, a soft inner shoe and a soft outer shoe, said soft outer shoe including an outer sole, a tongue and a closure overlapping the tongue to tighten a leg portion of the outer shoe, comprising the improvement wherein an elongate tension member is provided between the inner shoe and the outer shoe and exits said outer shoe through an opening in the leg portion, said tension member being connected to a first side of the outer sole and extending from said first side, over the inner shoe in the instep area, to a first turning point which said first turning point is connected to a second side of the outer sole opposite the first side, said tension member turning at said first turning point and extending longitudinally rearwardly to a second turning point located on said first side in the heel area, said tension member turning at said second turning point and extending upwardly to said opening so as to exit said outer shoe and define a grip on an exterior of said snowboard boot which is manually pullable for tightening said tension member to a tightened state which draws said instep area downwardly toward said outer sole in the region of said first turning point, said snowboard boot including a fixing device for releasably fixing said tension member in said tightened state.

10. The snowboard boot according to claim 9, wherein the tension member provides tightening of the snowboard boot which supplements tightening of said snowboard boot provided by said closure.

11. The snowboard boot according to claim 10, wherein the closure of the outer shoe is formed by a lacing which overlaps said tongue and engages said outer shoe for tightening said leg portion thereof.

12. The snowboard boot according to claim 1, wherein said tension member extends from a first end located forwardly of said instep area such that said tension member extends rearwardly and upwardly in the longitudinal direction of the shoe over the instep area to said first turning point and then extends rearwardly and downardly to said second turning point in the heel area.

13. The snowboard boot according to claim 12, wherein said tension member is free of turns between said first end and said first turning point, and is free of turns between said first and second turning points.

14. The snowboard boot according to claim 1, wherein said tension member draws said first turning point on said second side toward said first side of said outer sole when in said tightened state to effect tightening of said instep area.

15. The snowboard boot according to claim 9, wherein said second turning point and said tension member are fastened to the outer sole on said first side of the outer shoe, and said first turning point is fastened to the outer sole on the second side of the outer shoe.

16. The snowboard boot according to claim 15, wherein said fixing device is a clamp, said clamp being disposed on the outer side of the leg portion of the outer shoe above the opening to releasably engage said tension member upon upward pulling of said tension member.

* * * * *